US011229277B1

(12) United States Patent
Davies

(10) Patent No.: US 11,229,277 B1
(45) Date of Patent: Jan. 25, 2022

(54) YOGA STRAP

(71) Applicant: Keith Davies, San Anselmo, CA (US)

(72) Inventor: Keith Davies, San Anselmo, CA (US)

( * ) Notice: Subject to any disclaimer, the term of this patent is extended or adjusted under 35 U.S.C. 154(b) by 0 days.

(21) Appl. No.: 16/902,688

(22) Filed: Jun. 16, 2020

(51) Int. Cl.
*A45F 3/14* (2006.01)
*A63B 21/00* (2006.01)

(52) U.S. Cl.
CPC ..... *A45F 3/14* (2013.01); *A63B 21/4037* (2015.10); *A45F 2003/142* (2013.01)

(58) Field of Classification Search
CPC ..... A45F 3/14; A63B 21/4037
USPC ..... 224/576
See application file for complete search history.

(56) References Cited

U.S. PATENT DOCUMENTS 4,337,938 A * 7/1982 Rodriguez ..... A63B 69/0059 224/258
4,911,347 A * 3/1990 Wilhite ..... A45F 3/14 224/251
5,370,286 A * 12/1994 Newman ..... A45F 3/14 119/857
5,437,401 A * 8/1995 Seltzer ..... A45F 3/02 224/153
5,603,545 A * 2/1997 Benson ..... A45F 3/14 224/250
5,624,359 A * 4/1997 Dean ..... A61H 1/02 482/131
D457,725 S * 5/2002 Parsons ..... D3/327
6,446,849 B1 * 9/2002 Schleifer ..... A43B 5/0425 224/258
6,450,929 B1 * 9/2002 Markham ..... A63B 21/0552 482/121
6,571,541 B1 * 6/2003 Rees ..... B68C 1/14 54/23
6,648,191 B2 * 11/2003 Giggleman ..... A45F 3/14 224/254
6,921,354 B1 * 7/2005 Shifferaw ..... A63B 21/068 482/126
D508,323 S * 8/2005 Douglas ..... D3/328
7,044,896 B2 * 5/2006 Hetrick ..... A63B 21/00043 482/95
7,722,508 B2 * 5/2010 Hetrick ..... A63B 21/068 482/95
8,343,018 B2 * 1/2013 Moulton ..... A63B 23/035 482/91
9,968,474 B2 * 5/2018 Carpenter ..... A61H 1/0296
10,816,305 B1 * 10/2020 Beavers ..... F41C 33/007
2007/0173382 A1 * 7/2007 Axelrod ..... A63B 21/0004 482/91
2007/0265145 A1 * 11/2007 Teng ..... A63B 21/0004 482/91
2016/0023051 A1 * 1/2016 Lauener ..... A63B 7/00 482/143
2018/0333601 A1 * 11/2018 Coffman ..... A63B 23/1227
2020/0139185 A1 * 5/2020 Barben ..... A63B 21/0442

* cited by examiner

*Primary Examiner* — Nathan J Newhouse
*Assistant Examiner* — Lester L Vanterpool
(74) *Attorney, Agent, or Firm* — Kevin Roe

(57) ABSTRACT

An improved yoga strap comprising at least two adjustable and locking buckles, one buckle at end of the improved yoga strap to create a loop at each end of the yoga strap, giving the improved yoga strap more utilitarian applications than a standard yoga strap. A second embodiment of an improved yoga strap has a center loop. A third embodiment has an elastic resistance band and clips.

15 Claims, 17 Drawing Sheets

YOGA STRAP

BACKGROUND OF THE INVENTION

Field of the Invention

The present invention relates to an improved yoga strap for various uses in yoga exercises.

Description of the Prior Art

The standard yoga strap design has not changed for hundreds of years. The standard yoga strap design has a buckle at only one end; and this is designed only to create a single loop for use. This is cumbersome and not easy to store and this design has a limited use in a yoga class. What is needed is an improved yoga strap.

BRIEF DESCRIPTION OF THE DRAWINGS

Non-limiting and non-exhaustive embodiments of the invention are described with reference to the following drawings.

DETAILED DESCRIPTION OF THE PREFERRED EMBODIMENTS

Figure 1:
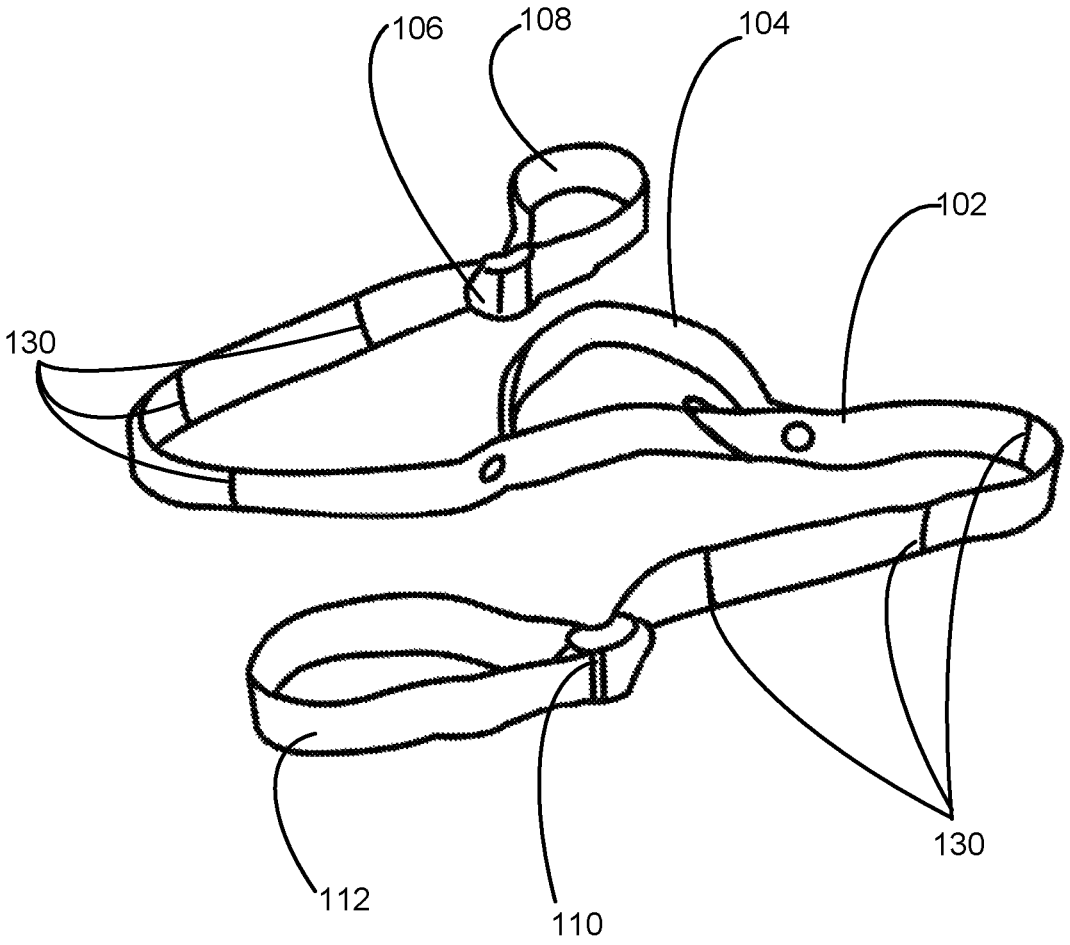
FIG. 1 illustrates an improved yoga strap with two buckles that each create a yoga strap loop, in accordance with one embodiment of the invention.

The invention provides an improved apparatus to practice yoga. Various embodiments of the invention can be applied to exercises that are beneficially used in yoga. Embodiments of the invention can be constructed from off-the-shelf components. In the embodiments disclosed below, different materials could be used in fabricating the yoga strap, including but not limited to various plastics (e.g., nylon, polyester or equivalents), resins, papers, fabrics (e.g., canvas or equivalents), plant fibers, ceramics, metals or metal alloys or a combination. In various embodiments, the yoga strap could be fabricated of solid or laminated polymers, with different levels of elasticity and strength. In various embodiments, the buckles could be fabricated of compositions of metal, ceramics, plastic or a combination. In various embodiments, the bar could be fabricated from compositions of wood, metal, plastic or a combination.

One embodiment of the invention is a yoga strap comprising two "looped and buckled" ends with buckles at both ends of the strap to create loops which will be shown in the drawings. The looping and locking buckles allow far more uses and benefits in the practice of yoga, as well as enabling the yoga strap to become a carrying strap for a yoga mat or bar after yoga practice.

One embodiment of the invention provides a "closed-loop" strap. There is no end to it. In one embodiment of the invention, there are two "locking buckles" at both ends as shown in the drawings below. Two the loops are completely adjustable to measure and balance (both sides of body) of the user. One object of one embodiment of the invention is to not only to create an easier way for a user to store and carry the user's yoga strap and mat, but also to make the strap easier to use and be far more effective during yoga practice. In one embodiment, the yoga strap also has a third loop in the very center of the strap allowing for more uses of the invention, in accordance with one embodiment of the invention.

FIG. 1 illustrates an improved yoga strap 102 with two buckles 106 and 110, that each create a yoga strap loop 108 and 112, in accordance with one embodiment of the invention. A plurality of color coordinated lines 130 are shown that can be used for strap measurements and will be shown in greater detail in FIG. 16. In this embodiment, there is a third loop 104, which in various embodiments could be adjustable or not adjustable.

Figure 2:
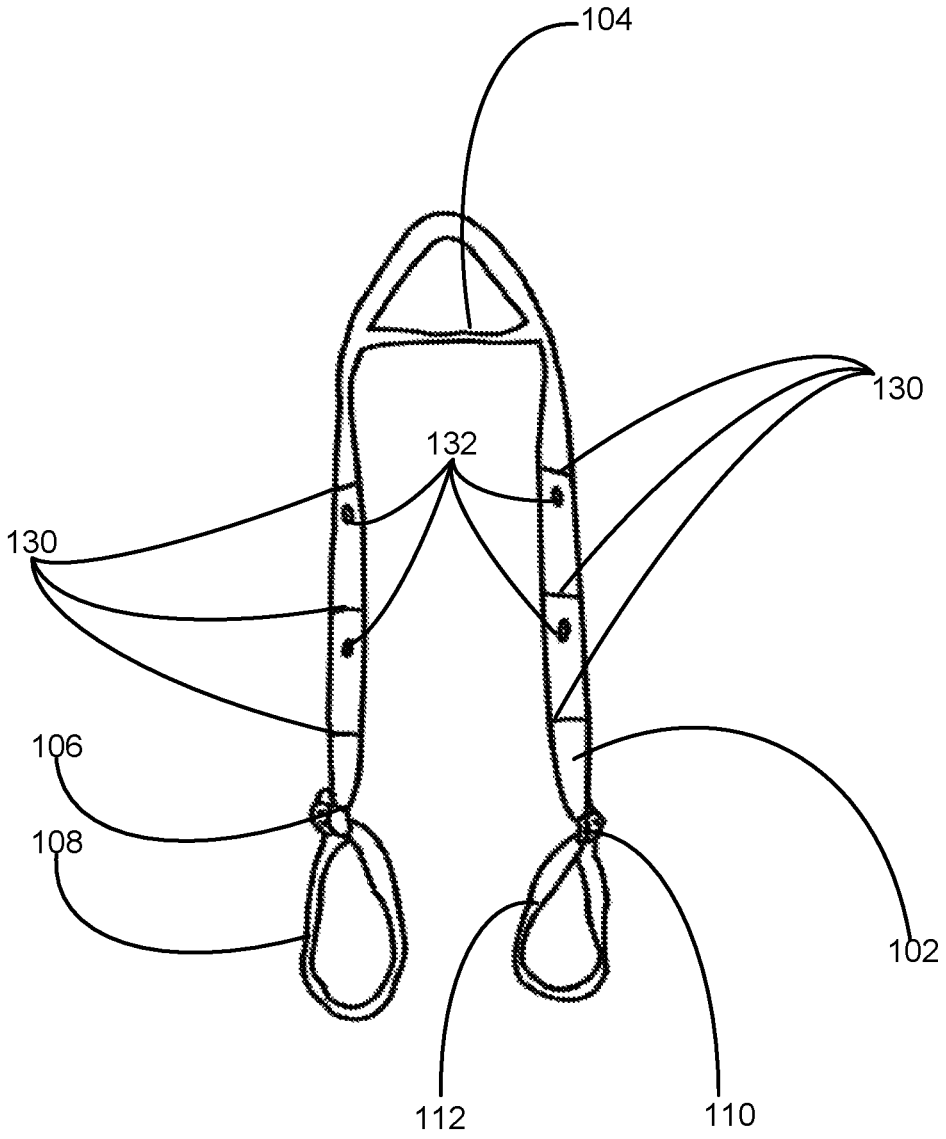
FIG. 2 illustrates an improved yoga strap with two buckles that each create a yoga strap loop, in accordance with one embodiment of the invention.

FIG. 2 illustrates an improved yoga strap 102 by itself with two buckles 106 and 110, that each create a yoga strap loop 108 and 112, in accordance with one embodiment of the invention. A plurality of color coordinated lines 130 are shown that can be used for strap measurements and will be shown in greater detail in FIG. 16. A plurality of measured holes 132 are shown that can be used for strap measurements and will be shown in greater detail in FIG. 17. In this embodiment, there is a third loop 104, which could be adjustable or not adjustable.

Figure 3:
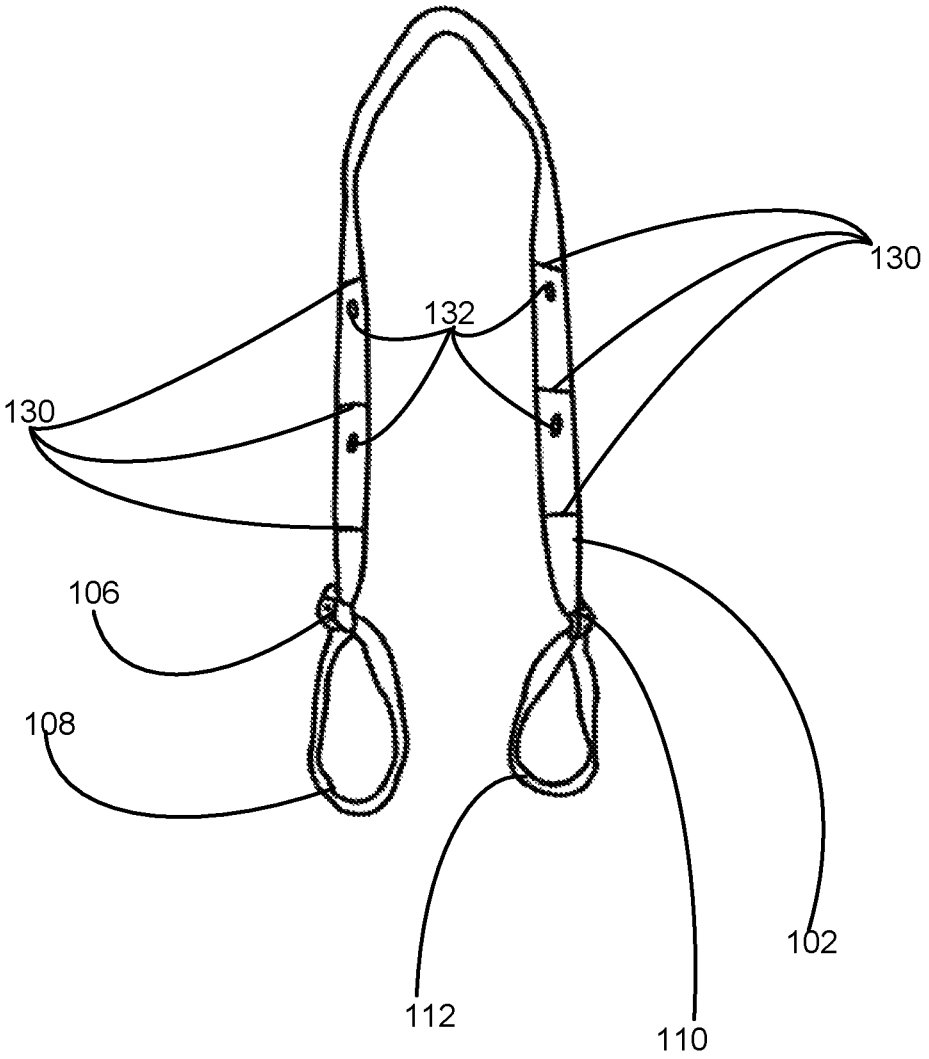
FIG. 3 illustrates an improved yoga strap with two buckles that each create a yoga strap loop, in accordance with another embodiment of the invention.

FIG. 3 illustrates an improved yoga strap 102 with two buckles 106 and 110, that each create a yoga strap loop 108 and 112, in accordance with another embodiment of the invention. In this embodiment, there is no third loop. A plurality of color coordinated lines 130 are shown that can be used for strap measurements and will be shown in greater detail in FIG. 16. A plurality of measured holes 132 are shown that can be used for strap measurements and will be shown in greater detail in FIG. 17.

Figure 4:
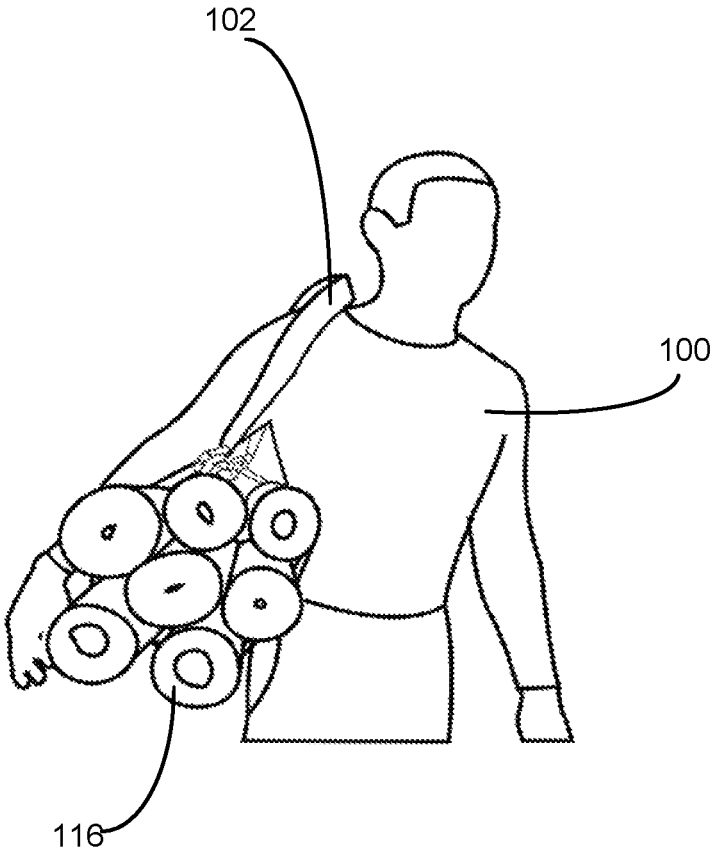
FIG. 4 illustrates an improved yoga strap that a user can use to carry one or more yoga mats or towels, in accordance with one embodiment of the invention.

FIG. 4 illustrates an improved yoga strap 102 that a user 100 can use to carry one or more yoga mats or towels 116, in accordance with one embodiment of the invention.

Figure 5:
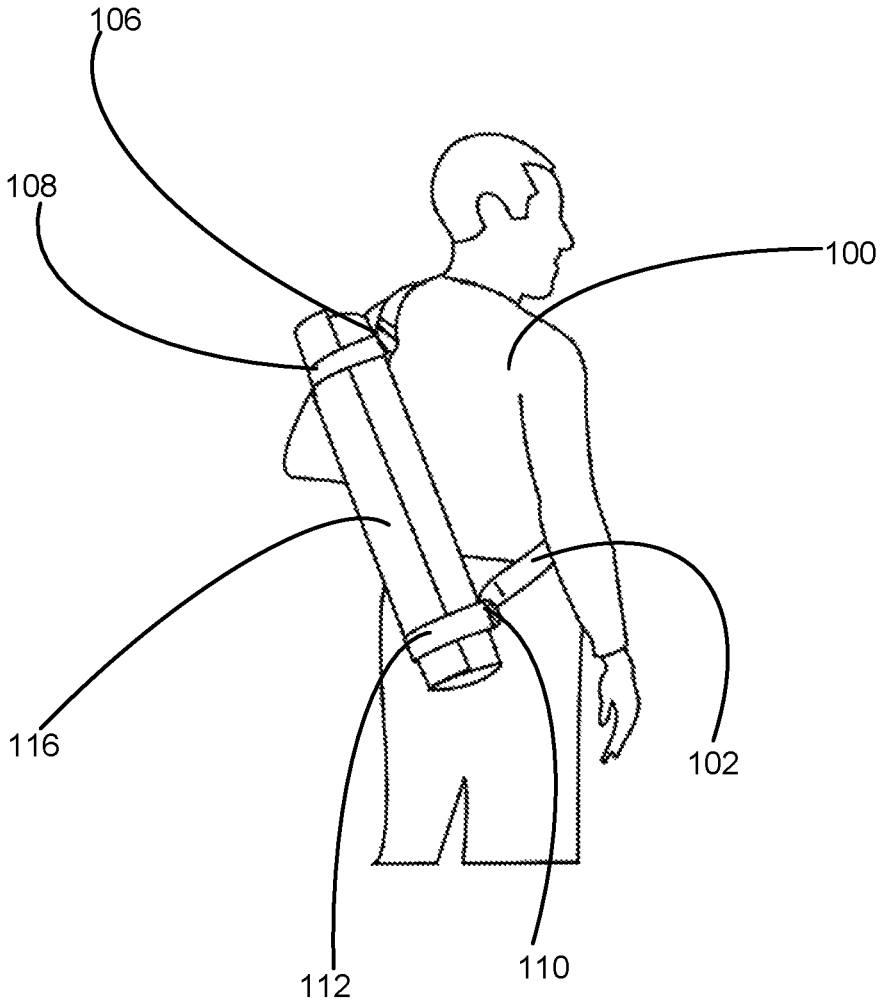
FIG. 5 illustrates an improved yoga strap with two buckles that each create a yoga strap loop, in accordance with one embodiment of the invention.

FIG. 5 illustrates an improved yoga strap 102 with two buckles 106 and 110, that each create a yoga strap loop 108 and 112, in accordance with one embodiment of the invention. In this embodiment, a user 100 is using the yoga strap to carry a yoga mat 116.

Figure 6:
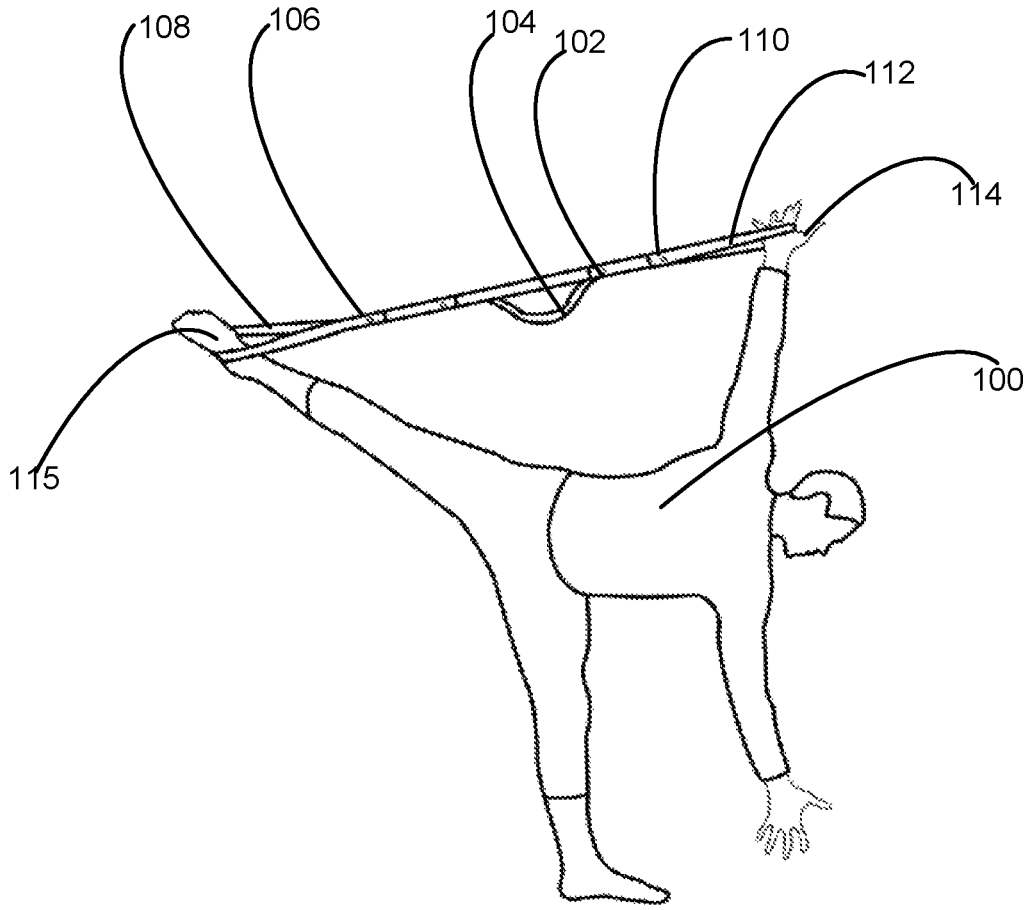
FIG. 6 illustrates an improved yoga strap with two buckles that each create a yoga strap loop, in accordance with one embodiment of the invention.

FIG. 6 illustrates an improved yoga strap 102 with two buckles 106 and 110, that each create a yoga strap loop 108 and 112, in accordance with one embodiment of the invention. The user 100 is inserting one foot 115 in loop 108 and one hand 114 in loop 112. In one embodiment, there is a third loop 104, that could either be adjustable or not adjustable.

Figure 7:
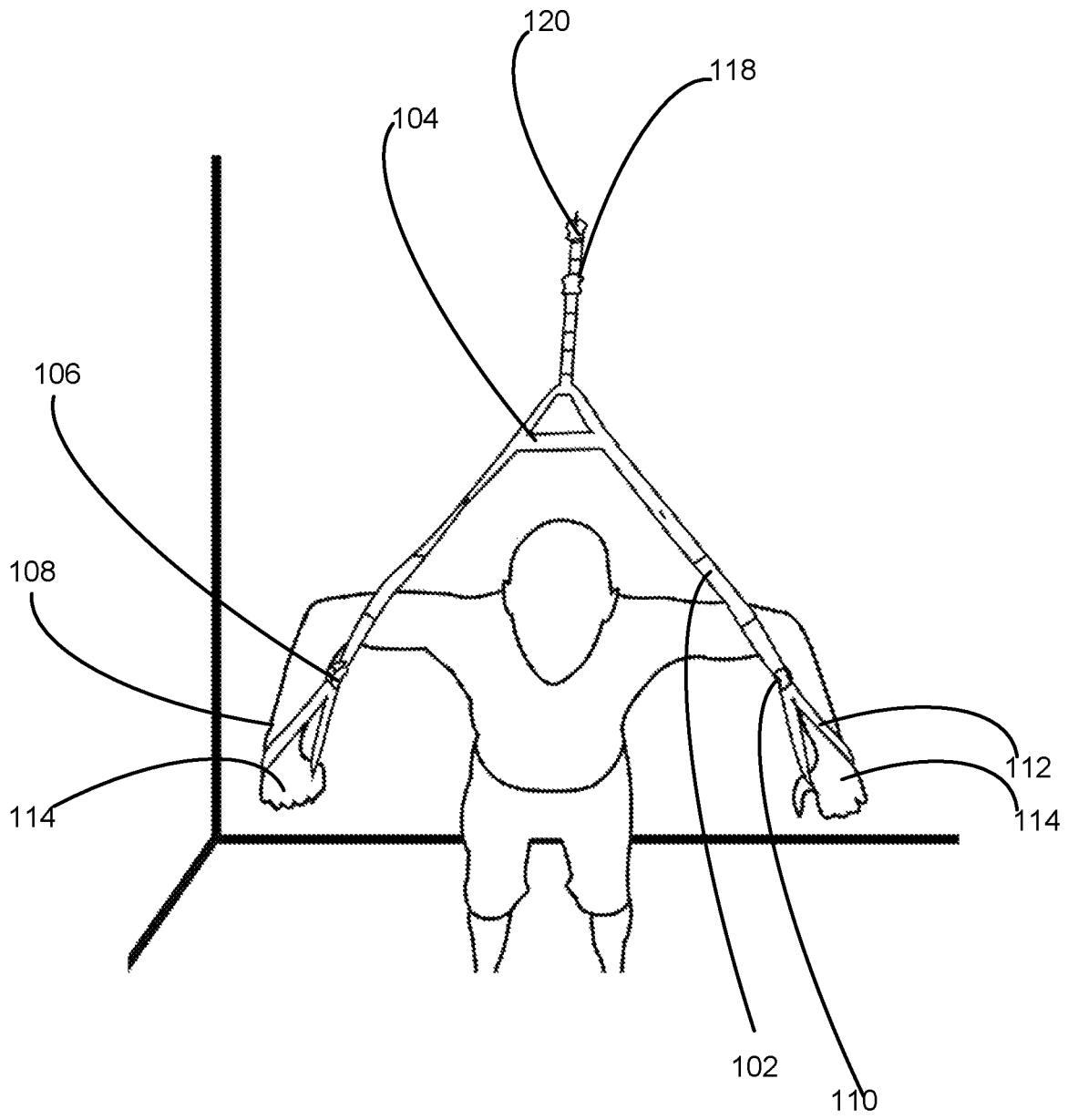
FIG. 7 illustrates an improved yoga strap with two buckles that each create a yoga strap loop, in accordance with one embodiment of the invention.

FIG. 7 illustrates an improved yoga strap 102 with two buckles 106 and 110, that each create a yoga strap loop 108 and 112, in accordance with one embodiment of the invention. The user 100 is inserting one hand 114 in loop 108 and another hand 114 in loop 112. The yoga strap 102 is coupled with another strap 118 to attach to a wall attachment point 120. In one embodiment, there is a third loop 104, which can be adjustable or not adjustable.

Figure 8A:
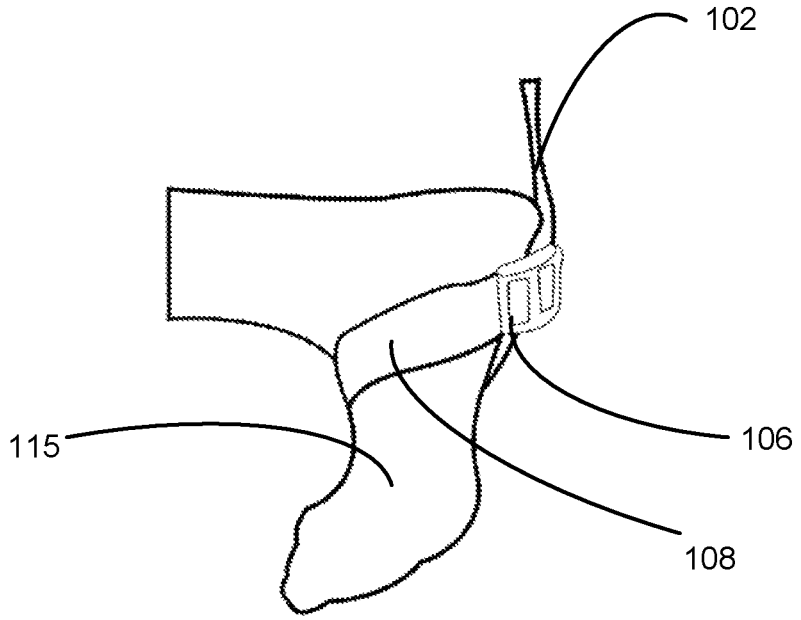
FIG. 8A illustrates an improved yoga strap with one buckle that creates a yoga strap loop, in accordance with one embodiment of the invention. The user is inserting one foot in the loop.

FIG. 8A illustrates an improved yoga strap 102 with one buckle 106 that creates a yoga strap loop 108, in accordance with one embodiment of the invention. The user is inserting one foot 115 in loop 108.

Figure 8B:
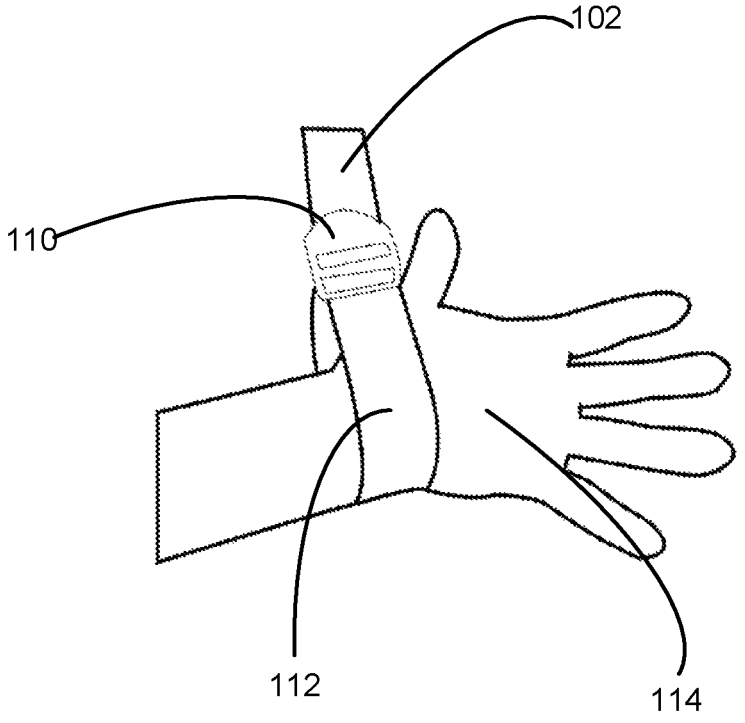
FIG. 8B illustrates an improved yoga strap with one buckle that creates a yoga strap loop, in accordance with one embodiment of the invention. The user is inserting one hand in the loop.

FIG. 8B illustrates an improved yoga strap 102 with one buckle 110 that creates a yoga strap loop 112, in accordance with one embodiment of the invention. The user is inserting one hand 114 in loop 112.

Figure 9:
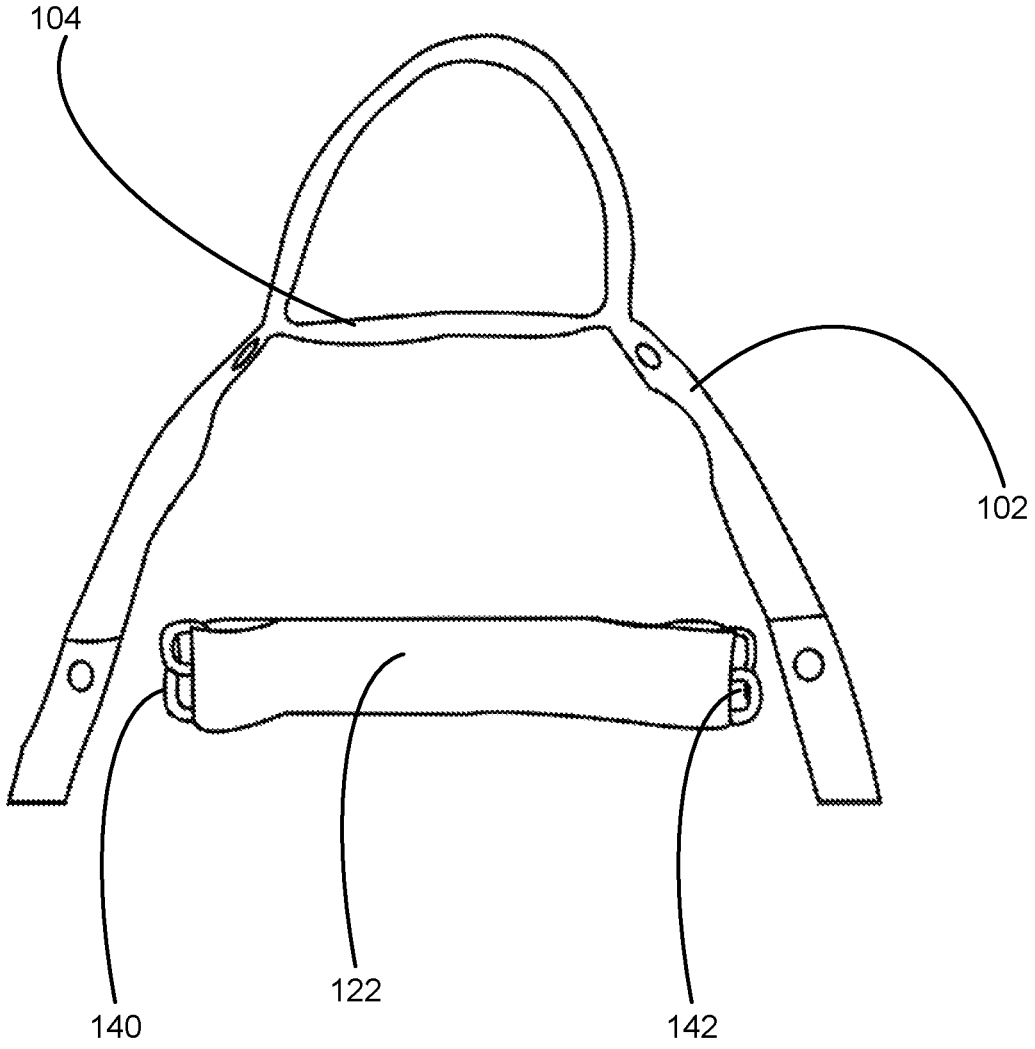
FIG. 9 illustrates an improved yoga strap and third loop. Also shown is an elastic resistance band with two clips, in accordance with one embodiment of the invention.

FIG. 9 illustrates an improved yoga strap 102 and third loop 104. Also shown is a elastic resistance band 122 for the yoga strap 102, with two clips 140 and 142, in accordance with one embodiment of the invention. The elastic resistance band 122 can have different levels of elasticity and be fabricated from rubber, synthetic rubber, or any other elastic and durable equivalent. The clips 140 and 142 need to be strong and typically would be fabricated from metal. The two clips 140 and 142 are interchangeable and each clip can lock into any one of the plurality of measured holes 132 of the yoga strap 102 to adjust the stretching of the yoga strap 102 for various exercise needs of a user (not shown). The elastic resistance band 122 is user adjustable in tension, wherein the elastic resistance band 122 is limited to stretch to a predetermined length before the improved yoga strap 102 prevents the elastic resistance band 122 from stretching any further, to minimize any risk that the elastic resistance band 122 snaps on the user (not shown).

Figure 10:
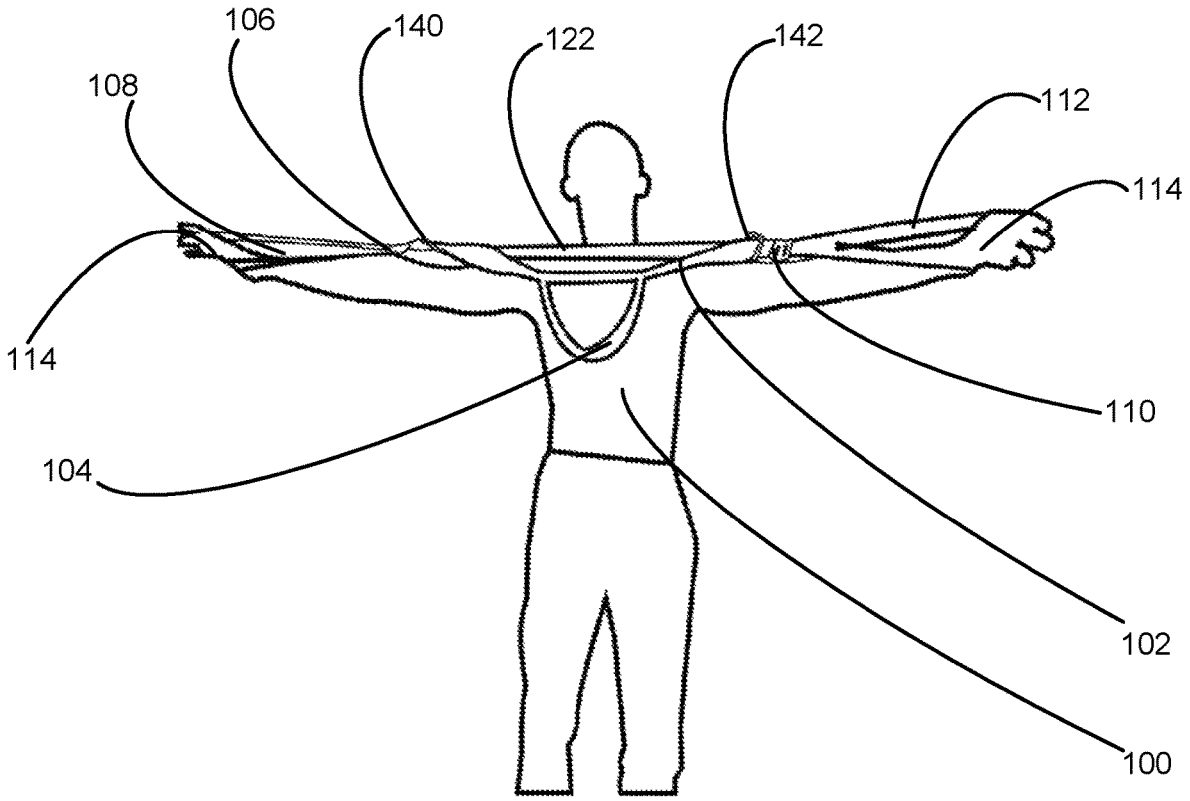
FIG. 10 illustrates an improved yoga strap with two buckles, that each create a yoga strap loop, in accordance with one embodiment of the invention. This is a back view of a user inserting one hand in one loop and another hand in a second loop.

FIG. 10 illustrates an improved yoga strap 102 with two buckles 106 and 110, that each create a yoga strap loop 108 and 112, in accordance with one embodiment of the invention. This is a back view of a user 100 inserting one hand 114 in loop 108 and another hand 114 in loop 112. Also shown is a elastic resistance band 122 for the yoga strap 102, with two clips 140 and 142, in accordance with one embodiment of the invention. The two clips 140 and 142 are interchangeable and each clip can lock into any one of the plurality of measured holes 132 of the yoga strap 102 to adjust the elastic stretch of the yoga strap 102 for the various exercise needs of a user (not shown). In this embodiment, there is a third loop 104 that is not used.

Figure 11:
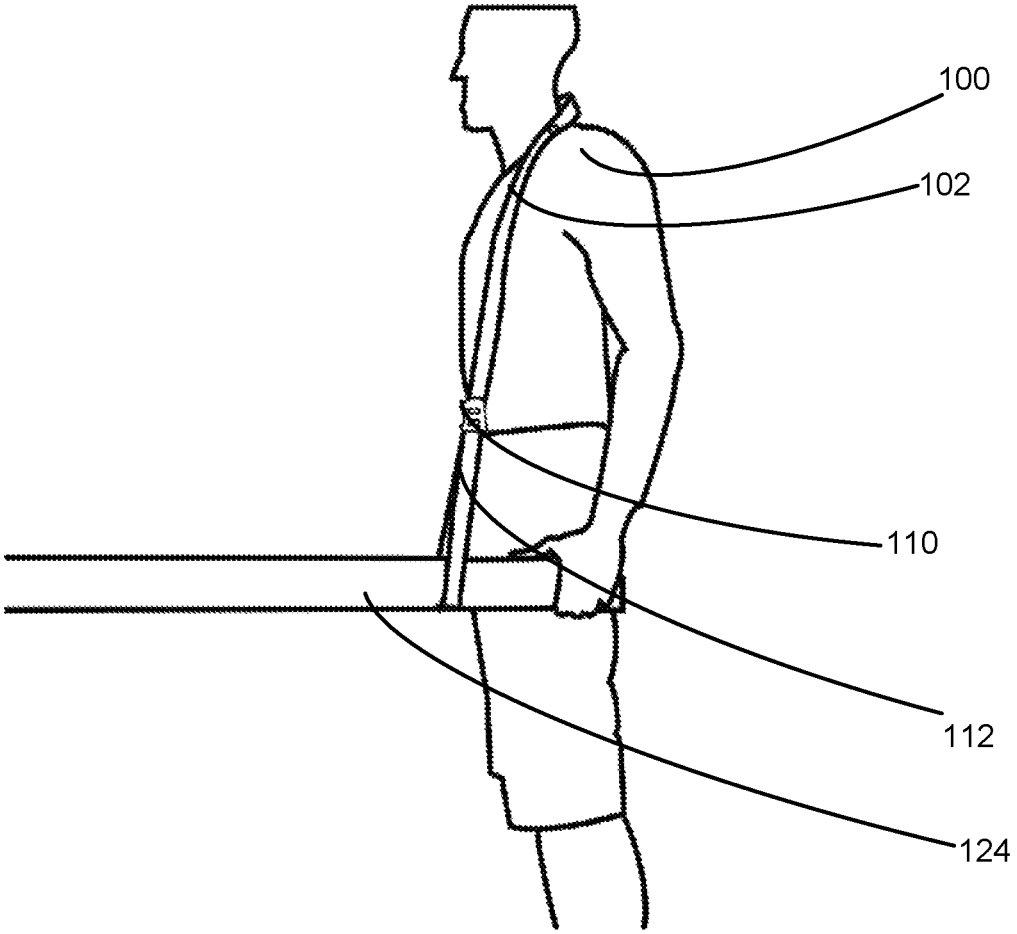
FIG. 11 illustrates an improved yoga strap with one buckle that creates a yoga strap loop, in accordance with one embodiment of the invention. This is a side view of a user using the loop as a sling to carry a bar.

FIG. 11 illustrates an improved yoga strap 102 by itself with one buckle 110 that creates a yoga strap loop 112, in accordance with one embodiment of the invention. This is a side view of a user 100 inserting using loop 112 as a sling to carry a bar 124.

FIG. 11 illustrates an improved yoga strap 102 with one buckle 110 that creates a yoga strap loop 112, in accordance with one embodiment of the invention. This is a side view of a user 100 using loop 112 as a sling to carry a bar 124.

Figure 12:
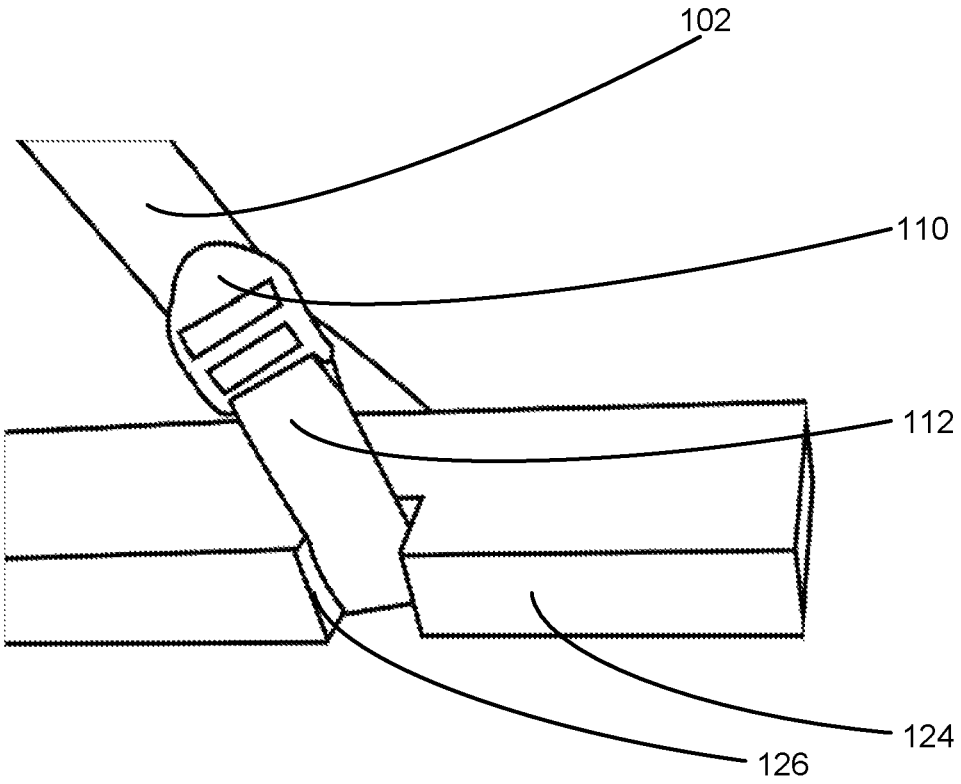
FIG. 12 illustrates an improved yoga strap with one buckle that creates a yoga strap loop, in accordance with one embodiment of the invention. This is a view of a loop used as a sling to carry a bar.

FIG. 12 illustrates an improved yoga strap 102 by itself with one buckle 110 that creates a yoga strap loop 112, in accordance with one embodiment of the invention. This is a view of a loop 112 used as a sling to carry a bar 124 having a notch 126.

Figure 13:
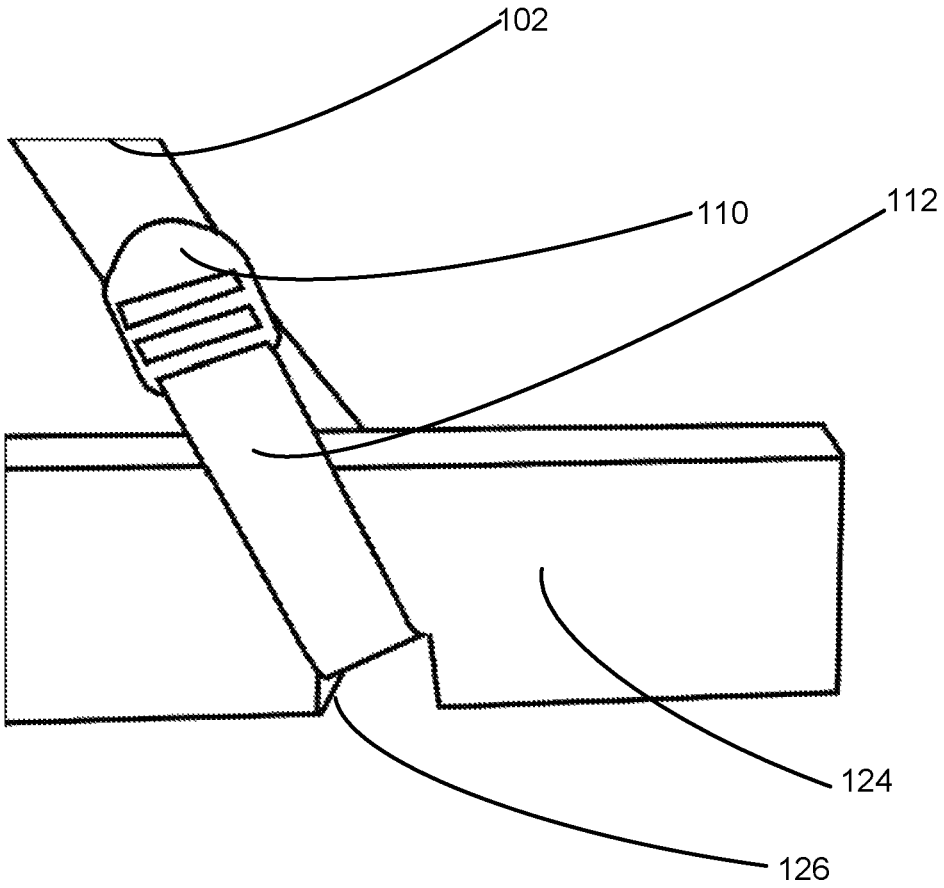
FIG. 13 illustrates an improved yoga strap with one buckle that creates a yoga strap loop, in accordance with one embodiment of the invention.

FIG. 13 illustrates an improved yoga strap 102 with one buckle 110 that creates a yoga strap loop 112, in accordance with one embodiment of the invention. This is a view of a loop 112 used as a sling to carry a bar 124 having a notch 126.

Figure 14:
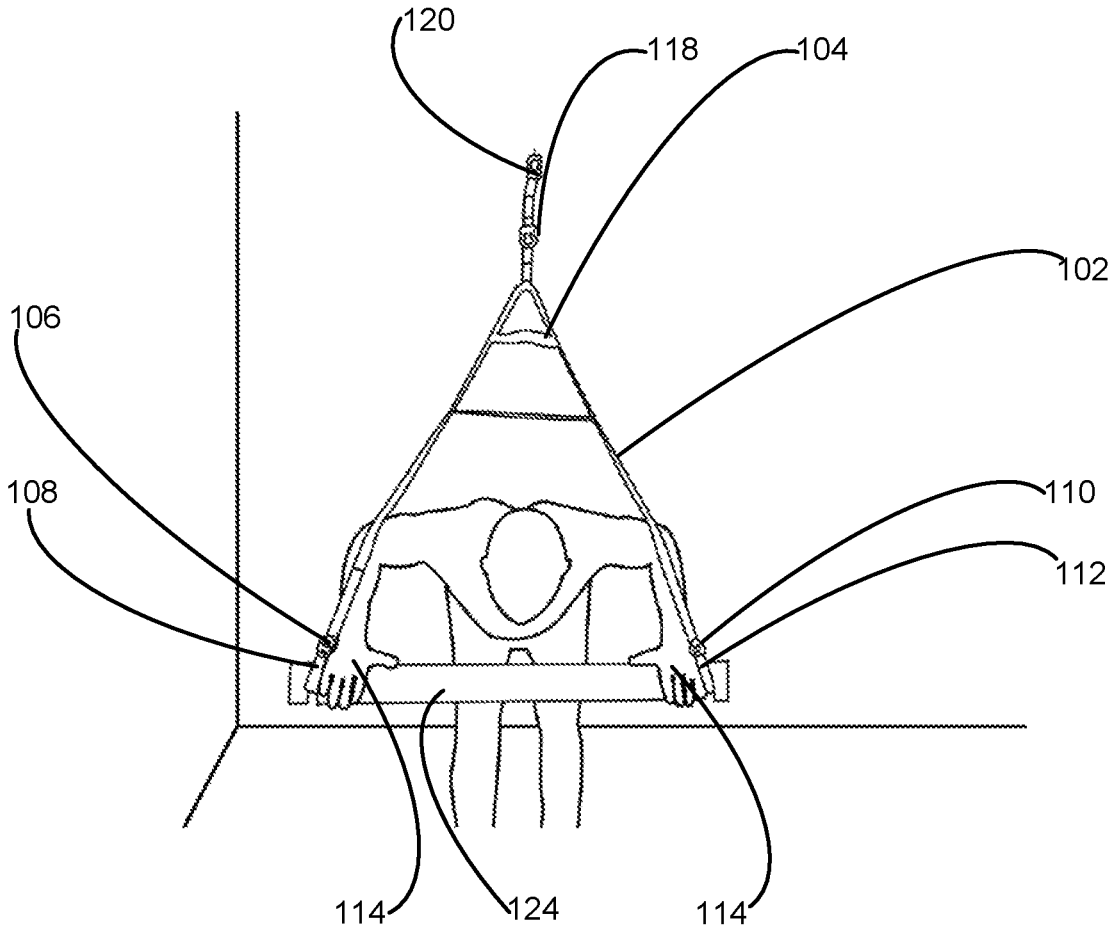
FIG. 14 illustrates an improved yoga strap with two buckles, that each create a yoga strap loop, in accordance with one embodiment of the invention. The user has inserted a bar in both loops. The yoga strap is coupled with another strap to attach to a wall attachment point.

FIG. 14 illustrates an improved yoga strap 102 with two buckles 106 and 110, that each create a yoga strap loop 108 and 112, in accordance with one embodiment of the invention. The user 100 is pushing his hands 114 on a bar 124 inserted in loop 108 and in loop 112. The yoga strap 102 is coupled with another strap 118 to attach to a wall attachment point 120. In one embodiment, there is a third loop 104.

Figure 15:
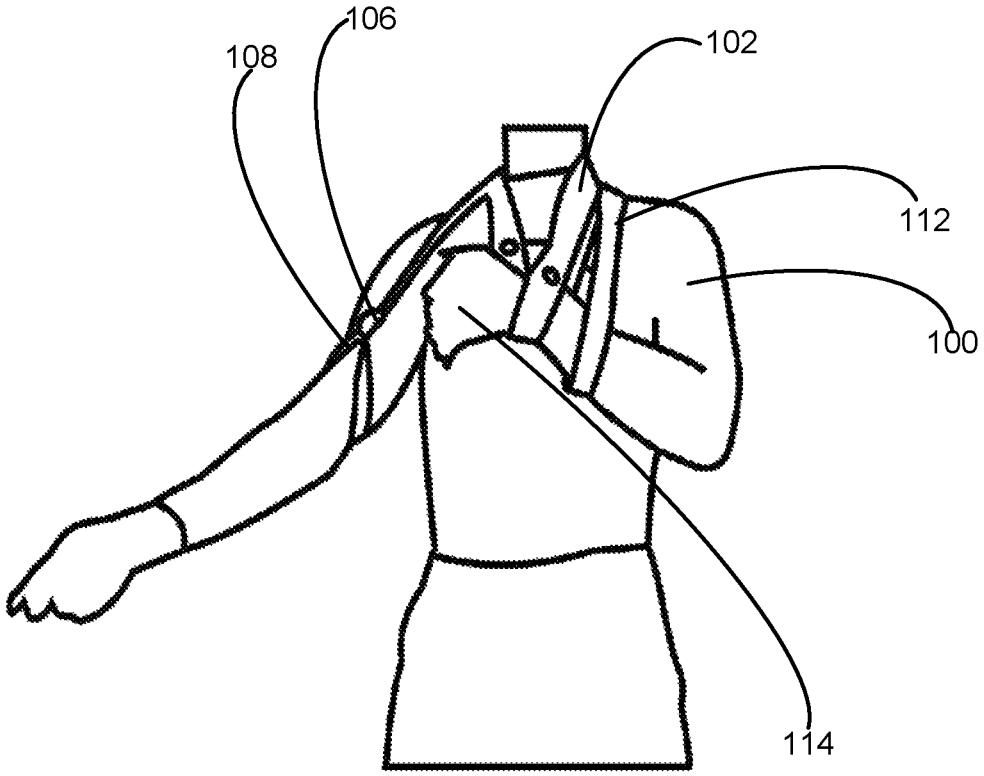
FIG. 15 illustrates an improved yoga strap with one buckle shown and one buckle not shown, that each create a yoga strap loop, in accordance with one embodiment of the invention.

FIG. 15 illustrates an improved yoga strap 102 with one buckle 106 shown and one buckle not shown, that each create a yoga strap loop 108 and 112, in accordance with one embodiment of the invention. This is a front view of a user 100 using the yoga strap 102 wrapped around the user's neck as a wrist and arm sling, inserting one arm in loop 108 and the hand 114 of an opposite arm inserted in a loop of yoga strap 102 and also in loop 112.

Figure 16:
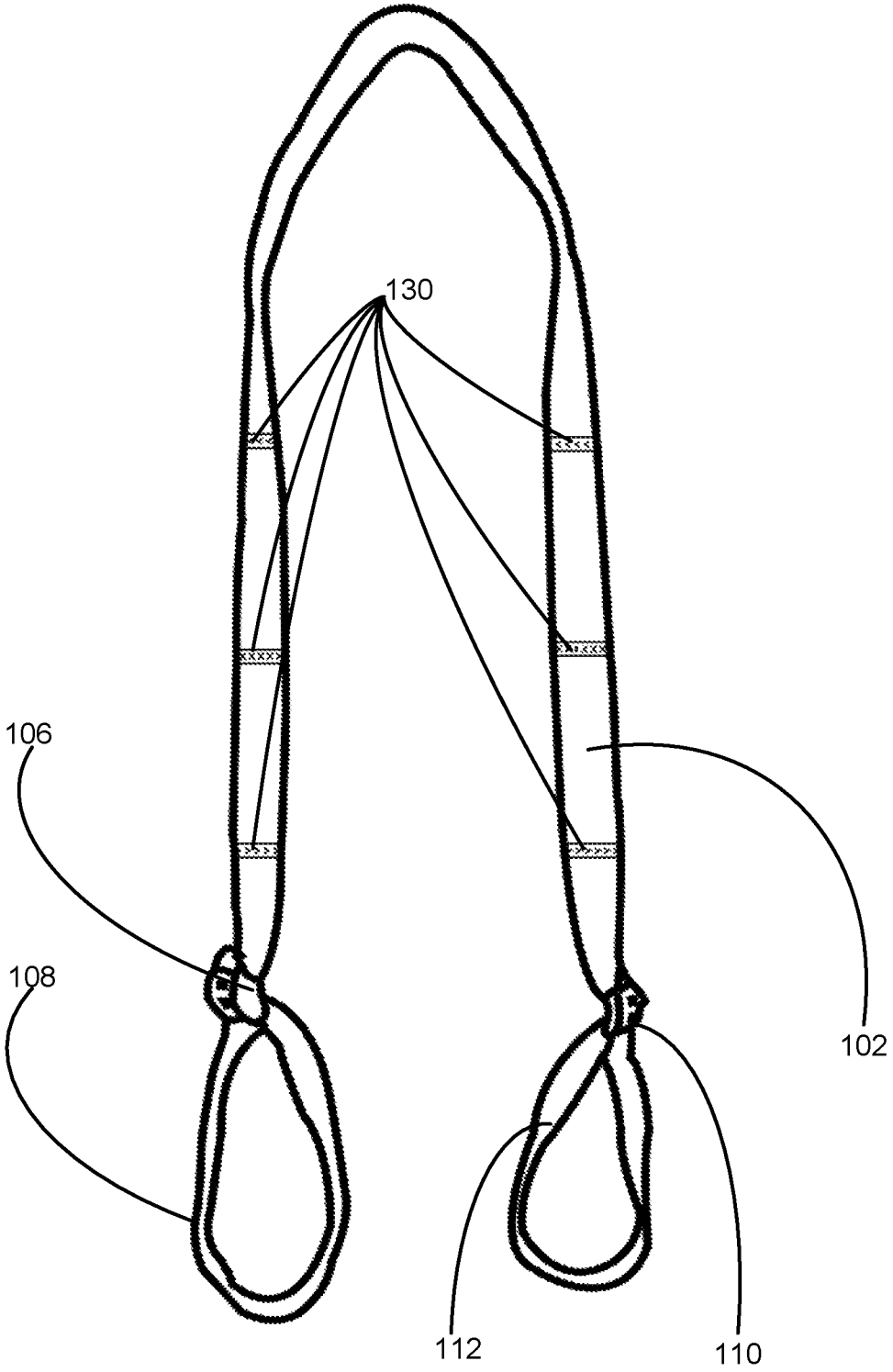
FIG. 16 illustrates an improved yoga strap with two buckles that each create a yoga strap loop, in accordance with one embodiment of the invention.

FIG. 16 illustrates an improved yoga strap 102 with two buckles 106 and 110, that each create a yoga strap loop 108 and 112, in accordance with another embodiment of the invention. A plurality of color coordinated lines 130 are shown to indicate where the buckles 106 and 110 could be placed for specific loops. Various embodiments of the invention could include a third loop (not shown).

Figure 17:
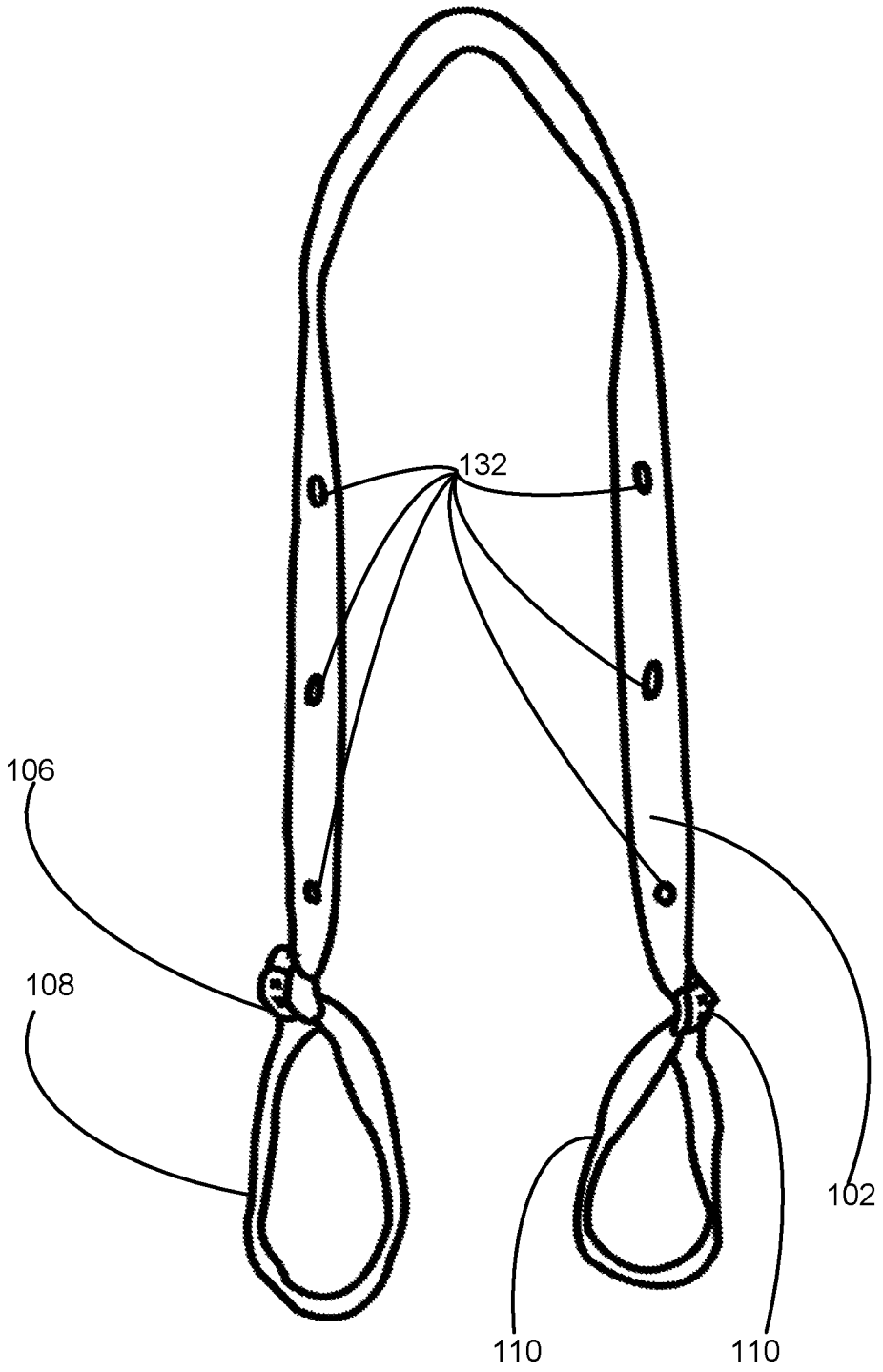
FIG. 17 illustrates an improved yoga strap with two buckles that each create a yoga strap loop, in accordance with one embodiment of the invention.

FIG. 17 illustrates an improved yoga strap 102 with two buckles 106 and 110, that each create a yoga strap loop 108 and 112, in accordance with another embodiment of the invention. A plurality of measured holes 132 indicate where the buckles 106 and 110 could be placed for specific loops. Various embodiments of the invention could include a third loop (not shown).

The exemplary embodiments described herein are for purposes of illustration and are not intended to be limiting. Therefore, those skilled in the art will recognize that other embodiments could be practiced without departing from the scope and spirit of the claims set forth below.

What is claimed is:

1. An improved yoga strap, comprising:

a strap having a first strap end and a second strap end, wherein the strap has two sides, and a first buckle for the first strap end and a second buckle for the second strap end, wherein the first buckle creates a first loop at the first strap end and the second buckle creates a second loop at the second strap end, where in the first buckle and second buckle are each adjustable and lock into place when configured, wherein a plurality of measured holes are located along both sides of the improved yoga strap, so that the first buckle and the second buckle can each be selectively buckled near one of the measured holes of the plurality of measured holes and an elastic resistance band having two ends and one clip on each end of the elastic resistance band to attach each end of the elastic resistance band to any measured hole of the plurality of measured holes and adjust the elastic stretch of the improved yoga strap.

2. The improved yoga strap of claim 1, wherein the improved yoga strap creates a carrying strap for easier storage and travel.

3. The improved yoga strap of claim 1, wherein the improved yoga strap can be used by itself, or two improved yoga straps can be used as a pair, to create an adjustable exercise weight-training suspension system.

4. The improved yoga strap of claim 1, wherein a plurality of color coordinated lines along both sides of the improved yoga strap facilitate a quick and precise adjustment of the first buckle and the second buckle.

5. The improved yoga strap of claim 1, wherein the elastic resistance band having two ends and one clip on each end of the elastic resistance band to attach each end of the elastic resistance band to any measured hole of the plurality of measured holes, and wherein the elastic resistance band is user adjustable in tension, wherein the elastic resistance band is limited to stretch to a predetermined length before the improved yoga strap prevents the elastic resistance band from stretching any further, to minimize any risk that the elastic resistance band snaps on the user.

6. The improved yoga strap of claim 1, further comprising:

a bar having a first end and second end, wherein the bar locks into place by one or more notches in its first end and second end, and the bar has at least two widths, allowing for user selection of the improved yoga strap configuration, and helps cushion the user's wrists and provide grip areas for the user to hold onto the bar.

7. The improved yoga strap of claim 1, wherein the improved yoga strap can be configured as a sling or tourniquet.

8. The improved yoga strap of claim 1, wherein the improved yoga strap can be configured as a stretcher bearer.

9. An improved yoga strap, comprising a strap having a first strap end and second strap end, wherein the strap has a center loop portion, wherein a plurality of measured holes are located along both sides of the improved yoga strap, so that a first buckle and a second buckle can be selectively buckled near one of the measured holes of the plurality of measured holes, an elastic resistance band having two ends and one clip on each end of the elastic resistance band to attach each end of the elastic resistance band to any measured hole of the plurality of measured holes and adjust the elastic stretch of the improved yoga strap, the first buckle for the first strap end and the second buckle for the second strap end, wherein the first buckle creates a first loop at the first strap end and the second buckle creates a second loop at the second strap end, where in the first buckle and the second buckle are each adjustable and lock into place when configured.

10. The improved yoga strap of claim 9, wherein the improved yoga strap creates a carrying strap for easier storage and travel.

11. The improved yoga strap of claim 9, wherein the improved yoga strap can be used by itself, or two improved yoga straps can be used as a pair, to create an adjustable exercise weight-training suspension system.

12. The improved yoga strap of claim 9, wherein a plurality of color coordinated lines along both sides of the improved yoga strap facilitate a quick and precise adjustment of the first buckle and the second buckle.

13. The improved yoga strap of claim 9, wherein the elastic resistance band having two ends and one clip on each end of the elastic resistance band to attach each end of the elastic resistance band to any measured hole of the plurality of measured holes is user adjustable in tension, wherein the elastic resistance band is limited to stretch to a predetermined length before the improved yoga strap prevents the elastic resistance band from stretching any further, to minimize any risk that the elastic resistance band snaps on the user.

14. The improved yoga strap of claim 9, further comprising:

a bar having a first end and second end, wherein the bar locks into place by one or more notches in its first end and second end, and the bar has at least two widths, allowing for user selection of the improved yoga strap configuration, and helps cushion the user's wrists and provide grip areas for the user to hold onto the bar.

15. An improved yoga strap, comprising:

a strap having a first strap end and a second strap end, wherein the strap has center loop portion, a first buckle for the first strap end and a second buckle for the second strap end, wherein the first buckle creates a first loop at the first strap end and the second buckle creates a second loop at the second strap end, where in the first buckle and second buckle are each adjustable and lock into place when configured, wherein a plurality of color coordinated lines along both sides of the improved yoga strap facilitate a quick and precise adjustment of the first buckle and the second buckle, a plurality of measured holes located along both sides of the improved yoga strap, so that the first buckle and the second buckle can be selectively locked into the plurality of measured holes; and an elastic resistance band having two ends and one clip on each end of the elastic resistance band to attach each end of the elastic resistance band to any measured hole of the plurality of measured holes and adjust the elastic stretch of the improved yoga strap.

* * * * *